US009326615B1

(12) United States Patent
LaPointe

(10) Patent No.: US 9,326,615 B1
(45) Date of Patent: May 3, 2016

(54) FURNITURE MEMBER WITH LEGREST EXTENSION

(71) Applicant: La-Z-Boy Incorporated, Monroe, MI (US)

(72) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 14/619,826

(22) Filed: Feb. 11, 2015

(51) Int. Cl.

| | |
|---|---|
| ***A47C 1/02*** | (2006.01) |
| ***A47C 1/032*** | (2006.01) |
| ***A47C 1/035*** | (2006.01) |
| ***A47C 1/0355*** | (2013.01) |
| ***A47C 7/50*** | (2006.01) |
| ***A47C 17/04*** | (2006.01) |

(52) U.S. Cl.
CPC ..... *A47C 7/506* (2013.01); *A47C 17/04* (2013.01)

(58) Field of Classification Search
CPC ..... A47C 7/506; A47C 17/04
USPC ..... 297/83, 84, 85 R
See application file for complete search history.

(56) References Cited

U.S. PATENT DOCUMENTS

| | | | | | |
|---|---|---|---|---|---|
| 4,350,387 | A | * | 9/1982 | Rogers, Jr. | A47C 1/0355 |
| 4,357,049 | A | * | 11/1982 | Rogers, Jr. | A47C 1/0355 |
| 4,418,957 | A | * | 12/1983 | Rogers, Jr. | A47C 1/0355 |
| 4,544,201 | A | * | 10/1985 | Rogers, Jr. | A47C 1/0355 |
| 5,088,789 | A | | 2/1992 | LaPointe et al. | |
| 5,582,457 | A | | 12/1996 | Komorowski et al. | |
| 5,975,627 | A | * | 11/1999 | LaPointe | A47C 1/0355 |
| 7,585,018 | B2 | | 9/2009 | LaPointe et al. | |
| 8,506,009 | B2 | | 8/2013 | LaPointe et al. | |
| 8,608,240 | B2 | | 12/2013 | Marshall et al. | |

* cited by examiner

*Primary Examiner* — Rodney B White
(74) *Attorney, Agent, or Firm* — Harness, Dickey & Pierce, P.L.C.

(57) ABSTRACT

A legrest mechanism for a furniture member may include a pantograph linkage movable between a retracted position and an extended position and a secondary linkage connected the pantograph linkage and supporting a legrest platform. The secondary linkage is rotatable relative to the pantograph linkage in response to movement of the pantograph linkage between the extended and retracted positions. The pantograph linkage may include support links, a swing link and a cross link. The swing link may be rotatably coupled to the support links. In the extended position, the secondary linkage provides additional extension for the legrest mechanism to increase a height of the legrest platform relative to a ground surface and to increase a distance between the legrest platform and a frame of the furniture member.

22 Claims, 19 Drawing Sheets

FURNITURE MEMBER WITH LEGREST EXTENSION

FIELD

The present disclosure relates to a legrest mechanism for a furniture member.

BACKGROUND

This section provides background information related to the present disclosure and is not necessarily prior art.

Furniture members such as chairs, sofas, loveseats, sectionals, and the like can include a mechanism that allows an occupant of the furniture member to move a legrest panel or platform from a stowed or retracted position to a deployed or extended position to support the legs and/or feet of the occupant. The positioning of the legrest platform relative to a seat portion of chair body of the furniture member when the legrest platform is in the extended position can have a significant impact on the occupant's comfort level.

SUMMARY

This section provides a general summary of the disclosure, and is not a comprehensive disclosure of its full scope or all of its features.

In one form, the present disclosure provides a legrest mechanism for a furniture member that includes a pantograph linkage movable between a retracted position and an extended position and a secondary linkage connected the pantograph linkage and supporting a legrest platform. The secondary linkage is rotatable relative to the pantograph linkage in response to movement of the pantograph linkage between the extended and retracted positions. In the extended position, the secondary linkage provides additional extension for the legrest mechanism to increase a height of the legrest platform relative to a ground surface and to increase a distance between the legrest platform and a frame of the furniture member.

In another form, the present disclosure provides a legrest mechanism that may include a pantograph linkage and a four-bar linkage. The pantograph linkage is movable between a retracted position and an extended position and may include first and second support links, a swing link, and first and second cross links. The first support link may be rotatably coupled at a first end to a drive member. A first end of the swing link may be rotatably coupled relative to a frame of a furniture member. An intermediate portion of the swing link may be rotatably coupled to the first support link. The second support link may be rotatably coupled to the second end of the swing link and oriented relative to the first support link such that an angle between the first and second support links is constant in both of the retracted and extended positions. The first cross link may be rotatably coupled to the first support link and rotatably coupled to the second support link. The second cross link may be rotatably coupled to the second support link and connected to the first cross link by a support member. The four-bar linkage may be connected the second cross link and supporting a legrest platform. The four-bar linkage may be rotatable relative to the second cross link in response to movement of the pantograph linkage between the extended and retracted positions.

In some configurations, the four-bar linkage rotates relative to the second cross link continuously as the pantograph linkage moves between the extended and retracted positions.

Such continuous rotation of the four-bar linkage may occur over the entire range of motion of the pantograph linkage.

In some configurations, the first cross link is rotatably coupled to a second end of the first support link and rotatably coupled to an intermediate portion of the second support link.

In some configurations, the four-bar linkage includes front and rear board links rotatably coupled to the second cross link and a bracket link rotatably coupled to the front and rear board links.

In some configurations, the support member is a portion of the rear board link.

In some configurations, the legrest platform is fixedly mounted to the bracket link.

In some configurations, the four-bar linkage includes front and rear board links rotatably coupled to the first cross link and a bracket link rotatably coupled to the front and rear board links.

In some configurations, the support member is a third support link that is rotatable relative to the rear board link.

In some configurations, the legrest platform is fixedly mounted to the bracket link.

In some configurations, the pantograph linkage includes a third support link that extends between and is rotatably coupled to the first and second cross links.

In some configurations, the first support link includes a first stop member and the drive link includes a second stop member that interferes with the first stop member when the pantograph linkage is in the extended position.

In some configurations, the legrest mechanism includes an ottoman link rotatably coupled to the second support link and the first cross link. The ottoman link may fixedly support an ottoman platform.

In some configurations, the four-bar linkage includes a stop member that interferes with the pantograph linkage in the retracted position to limit a range of motion of the legrest mechanism.

In another form, the present disclosure provides a legrest mechanism that may include a pantograph linkage and a secondary linkage. The pantograph linkage is movable between a retracted position and an extended position and may include first and second support links, a swing link, and a cross link. The first support link may be rotatably coupled at a first end to a drive member. The swing link may include an intermediate portion rotatably coupled to the first support link. The second support link may be rotatably coupled to the swing link and oriented relative to the first support link such that an angle between the first and second support links is constant in both of the retracted and extended positions. The cross link may be rotatably coupled to the second support link. The secondary linkage connected the cross link and including front and rear board links and a bracket link. The bracket link may fixedly support a legrest platform. The secondary linkage may be rotatable relative to the cross link in response to movement of the pantograph linkage between the extended and retracted positions.

In some configurations, the secondary linkage rotates relative to the cross link continuously as the pantograph linkage moves between the extended and retracted positions. Such continuous rotation of the secondary linkage may occur over the entire range of motion of the pantograph linkage.

In some configurations, the cross link is connected to another cross link by a support member.

In some configurations, the other cross link is rotatably coupled to the first support link and rotatably coupled to the second support link.

In some configurations, the pantograph linkage includes a third support link that extends between and is rotatably coupled to both cross links.

In some configurations, a first end of the swing link is rotatably coupled relative to a frame of a furniture member.

In some configurations, a second end of the swing link is rotatably coupled to the second support link.

In some configurations, the first support link includes a first stop member and the drive link includes a second stop member that interferes with the first stop member when the pantograph linkage is in the extended position.

In some configurations, the secondary linkage includes a stop member that interferes with the pantograph linkage in the retracted position to limit a range of motion of the legrest mechanism.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
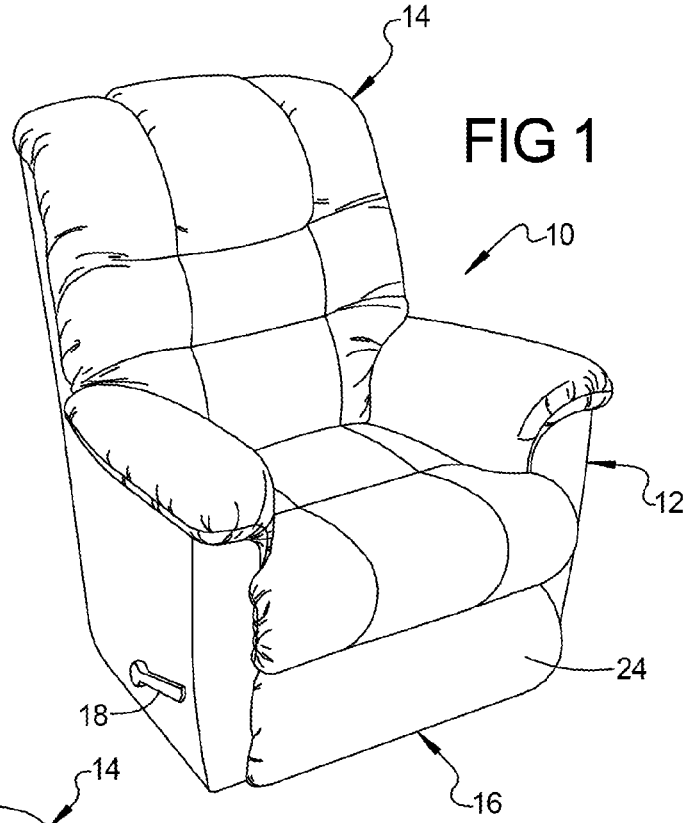
FIG. 1 is a perspective view of a furniture member having a legrest in a retracted position.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
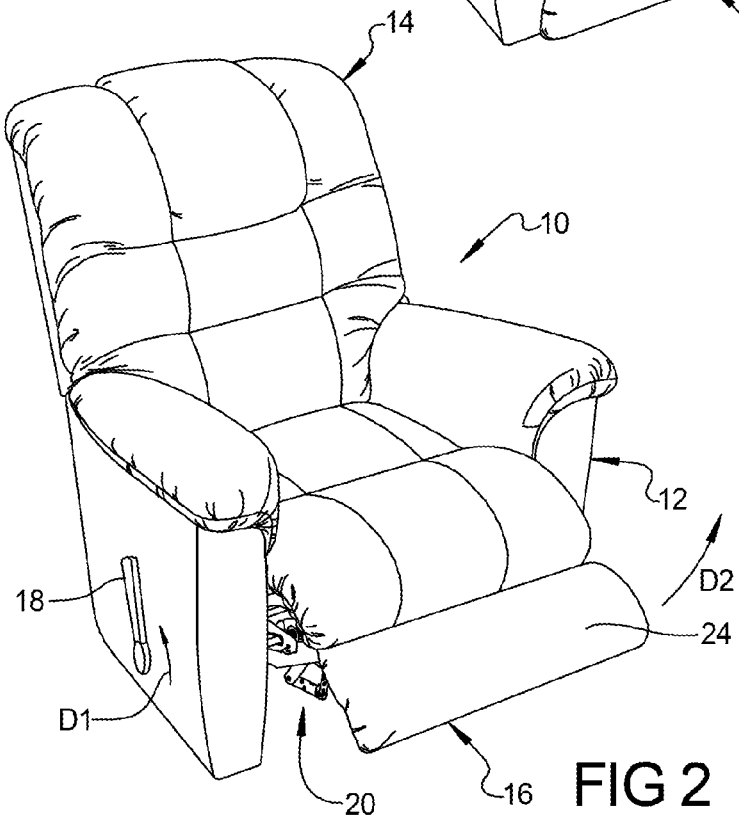
FIG. 2 is a perspective view of the furniture member of FIG. 1 with the legrest in a partially extended position.

With reference to FIGS. 1 and 2, a furniture member 10 is provided that includes a chair body 12, a seatback 14, and an extendable legrest 16. The seatback 14 may be movable relative to the chair body 12 between an upright position (FIGS. 1 and 2) and a reclined position (not shown). A handle 18 may be located on a side of the chair body 12 and may be rotated relative to the chair body 12 in a direction D1 to actuate a legrest mechanism 20 (FIG. 2) that can move the legrest 16 relative to the chair body 12 in a direction D2 toward a deployed or extended position (FIG. 5). The handle 18 can also be rotated in the direction opposite direction D1 to move the legrest 16 in the direction opposite direction D2 toward a stowed or retracted position (shown in FIGS. 1 and 3). The legrest 16 may include a legrest board or platform 22 (shown in FIGS. 3-5) covered in padding and upholstery 24 (shown in FIGS. 1 and 2).

Referring now to FIGS. 3-13, the legrest mechanism 20 will be described in detail. As shown in FIG. 5, for example, the legrest mechanism 20 may include a drive rod 26, a pair of drive links 28 (only one shown), a pair of pantograph linkages 30 (only one shown), and a pair of secondary linkages 32 (only one shown). The secondary linkages 32 are attached to corresponding ones of the pantograph linkages 30 and cooperate to support the legrest platform 22.

Figure 5:
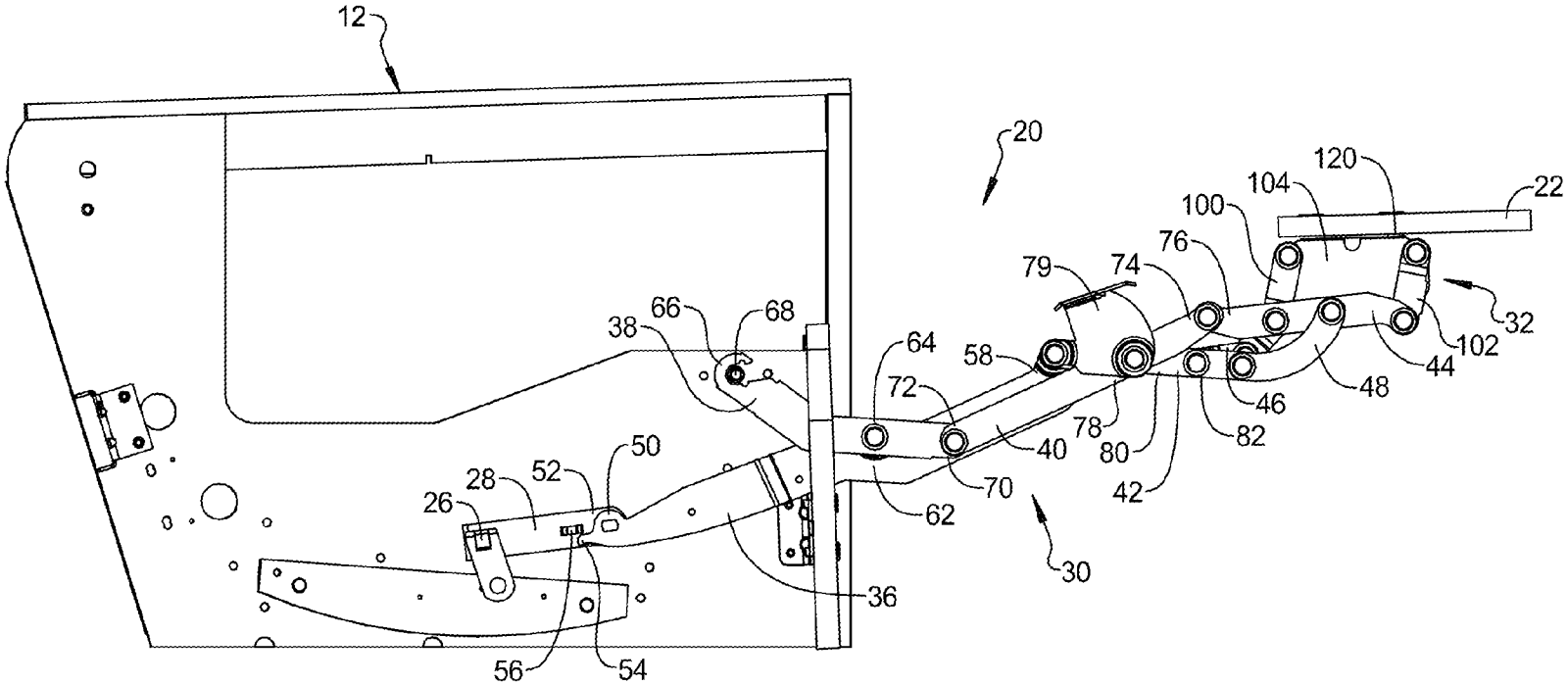
FIG. 5 is a side view of the portion of the chair body and the legrest mechanism of FIG. 3 in a fully extended position.
Figure 6:
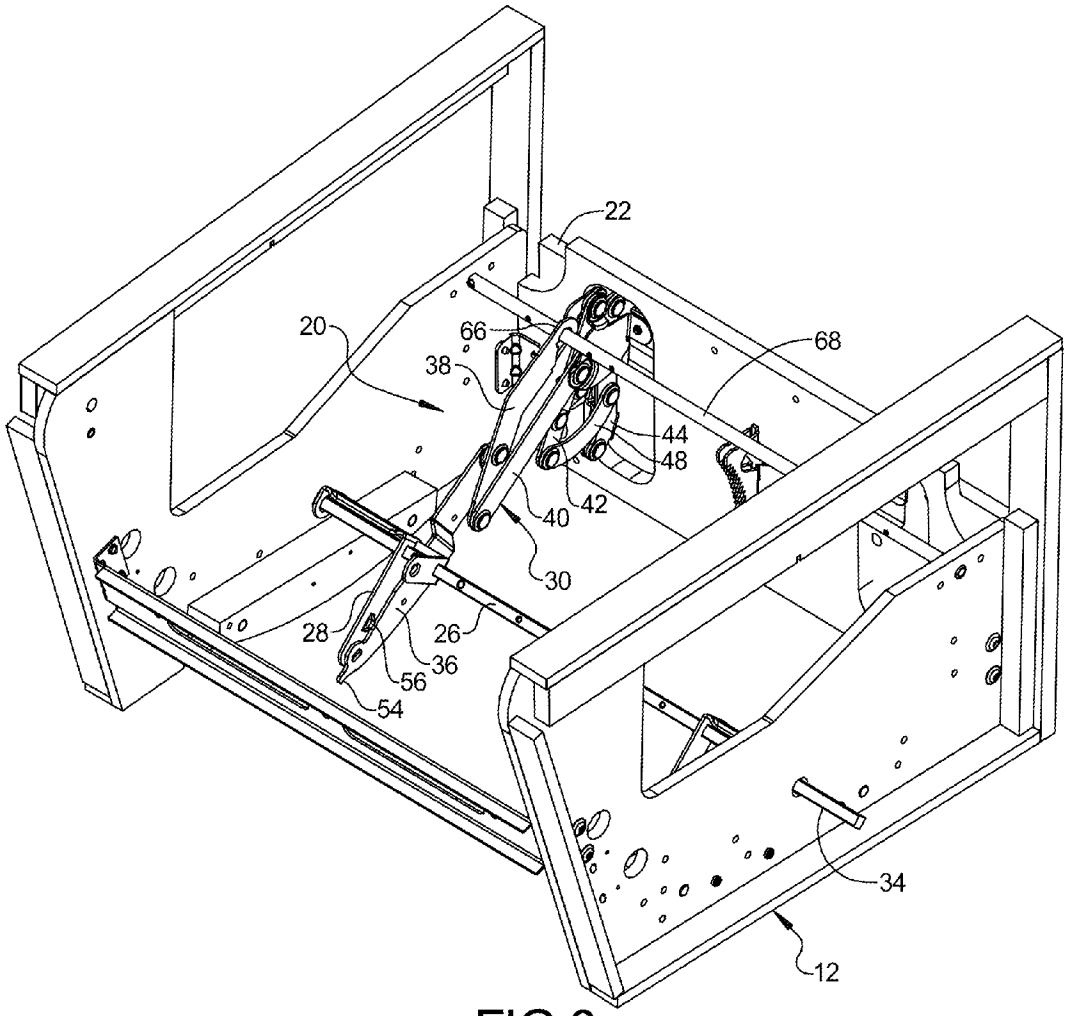
FIG. 6 is a perspective view of the portion of the chair body and a portion of the legrest mechanism of FIG. 3 in the retracted position, wherein one of a pair of pantograph linkages and one of a pair of secondary linkages of the legrest mechanism are removed from FIG. 6 for simplicity.
Figure 7:
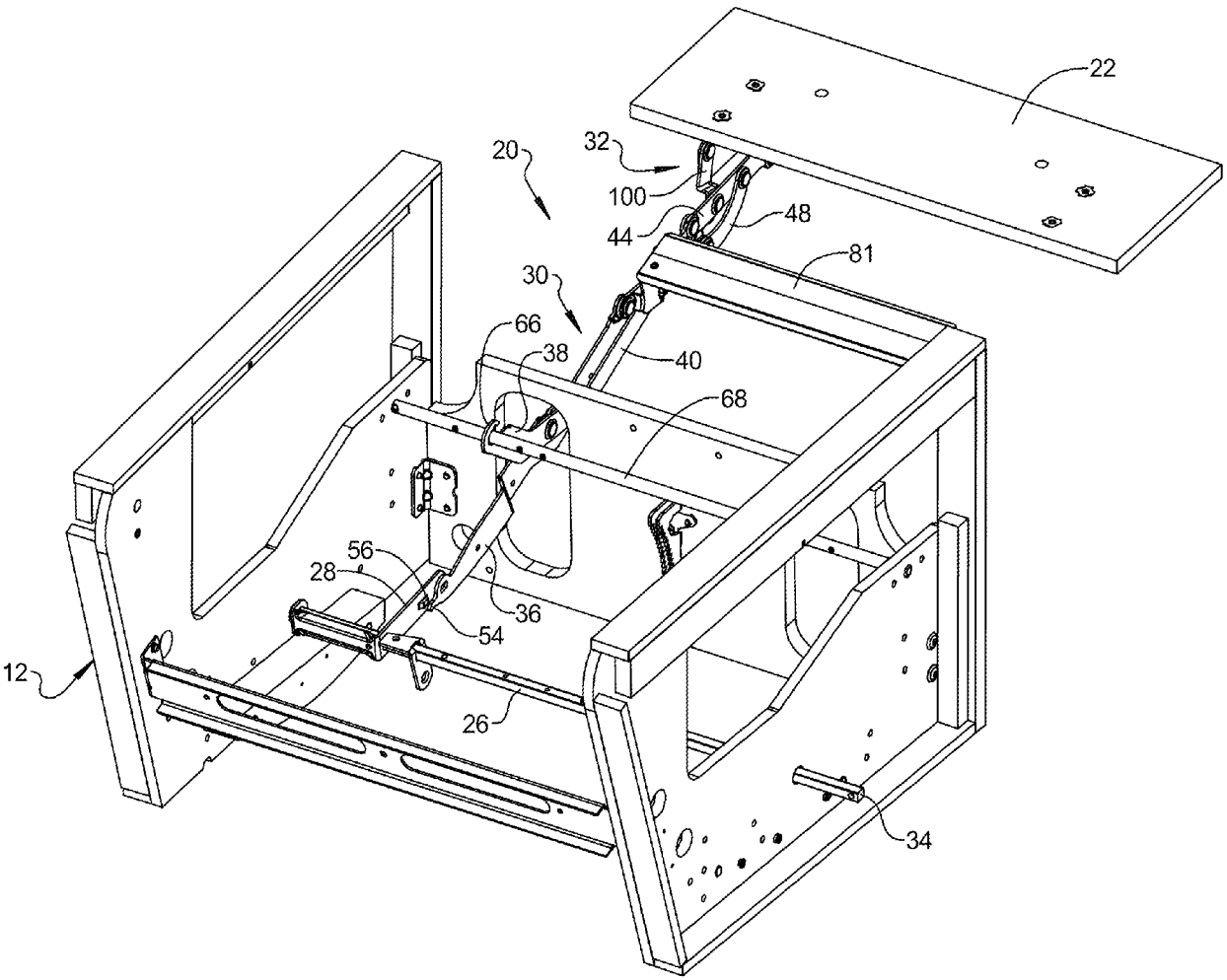
FIG. 7 is a perspective view of the portion of the chair body and the portion of the legrest mechanism of FIG. 6 in the fully extended position.

As shown in FIG. 6, the drive rod 26 may span a width of the chair body 12 and may be rotatably supported by the chair body 12. While not specifically shown, the handle 18 (FIGS. 1 and 2) may be fixedly attached to an end 34 (FIG. 6) of the drive rod 26 such that rotation of the handle 18 relative to the chair body 12 causes corresponding rotation of the drive rod 26 relative to the chair body 12. The drive links 28 are attached to the drive rod 26 for rotation with the drive rod 26 relative to the chair body 12. The pantograph linkages 30 are rotatably connected to corresponding drive links 28 such that rotation of the drive rod 26 causes the pantograph linkages 30 to move between the retracted position (FIGS. 3 and 6) and the extended position (FIGS. 5 and 7).

Figure 10:
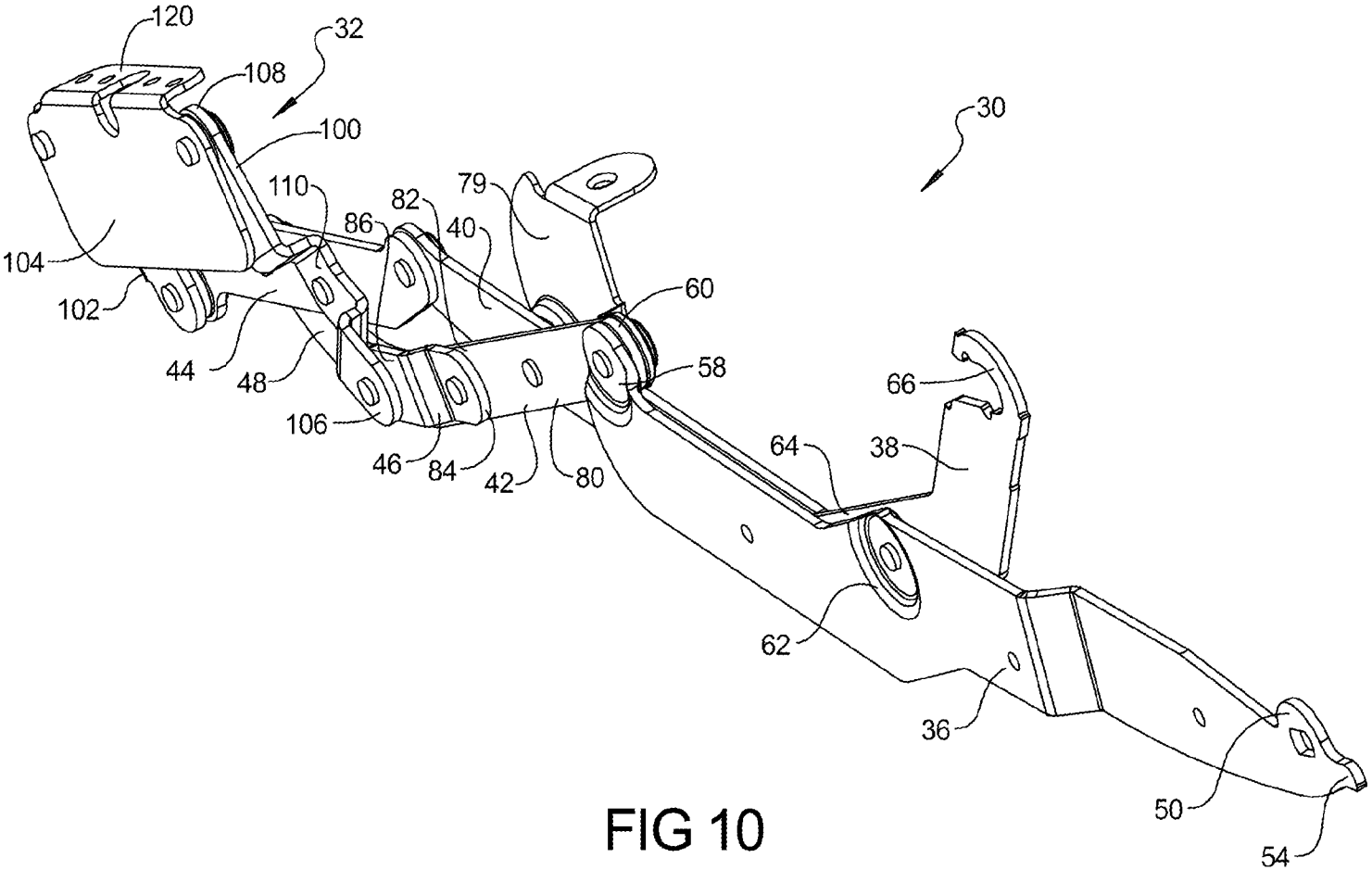
FIG. 10 is a first perspective view of the pantograph linkage and secondary linkage of FIG. 8 in the fully extended position.
Figure 11:
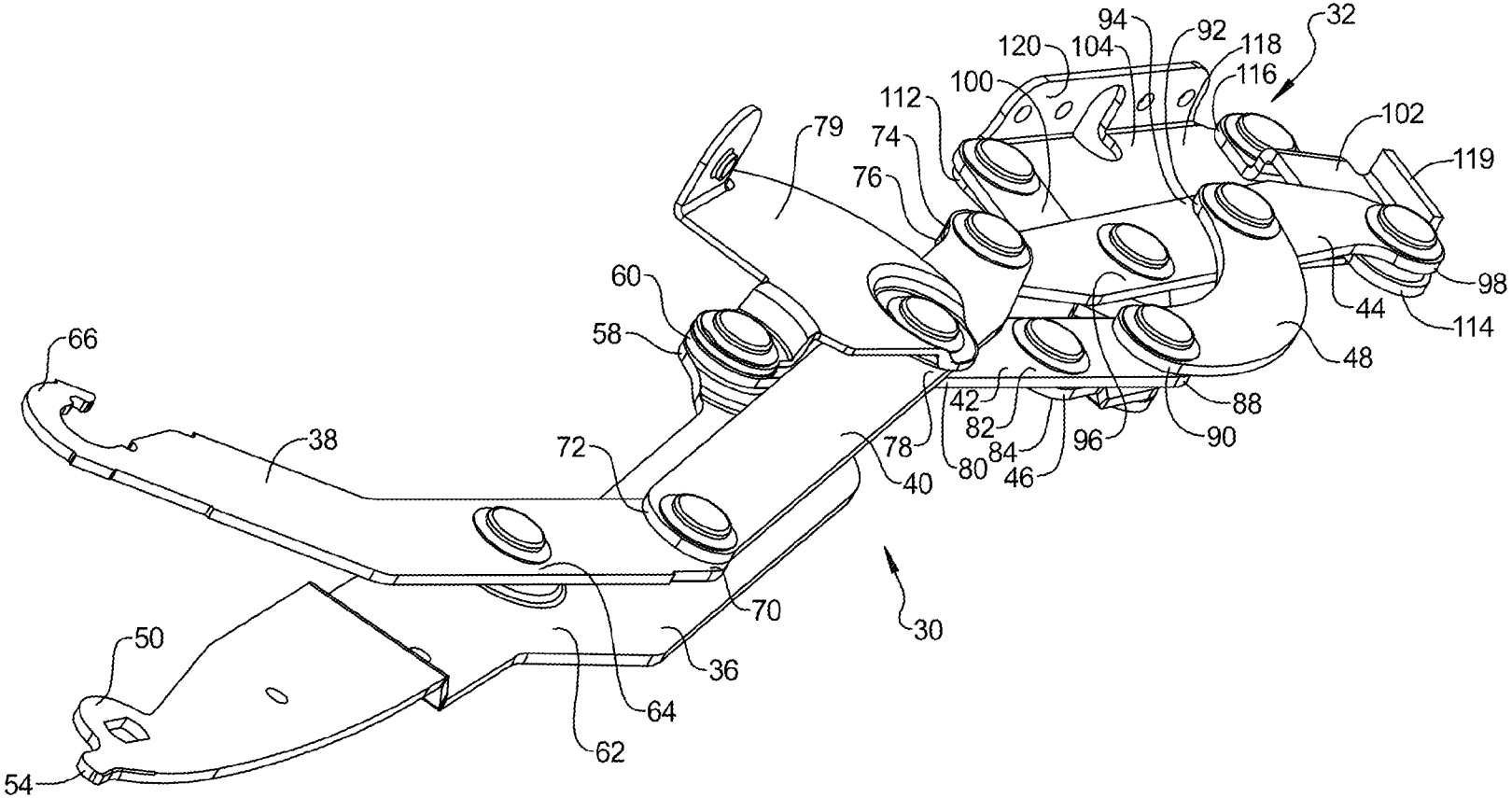
FIG. 11 is a second perspective view of the pantograph linkage and secondary linkage of FIG. 8 in the fully extended position.
Figure 12:
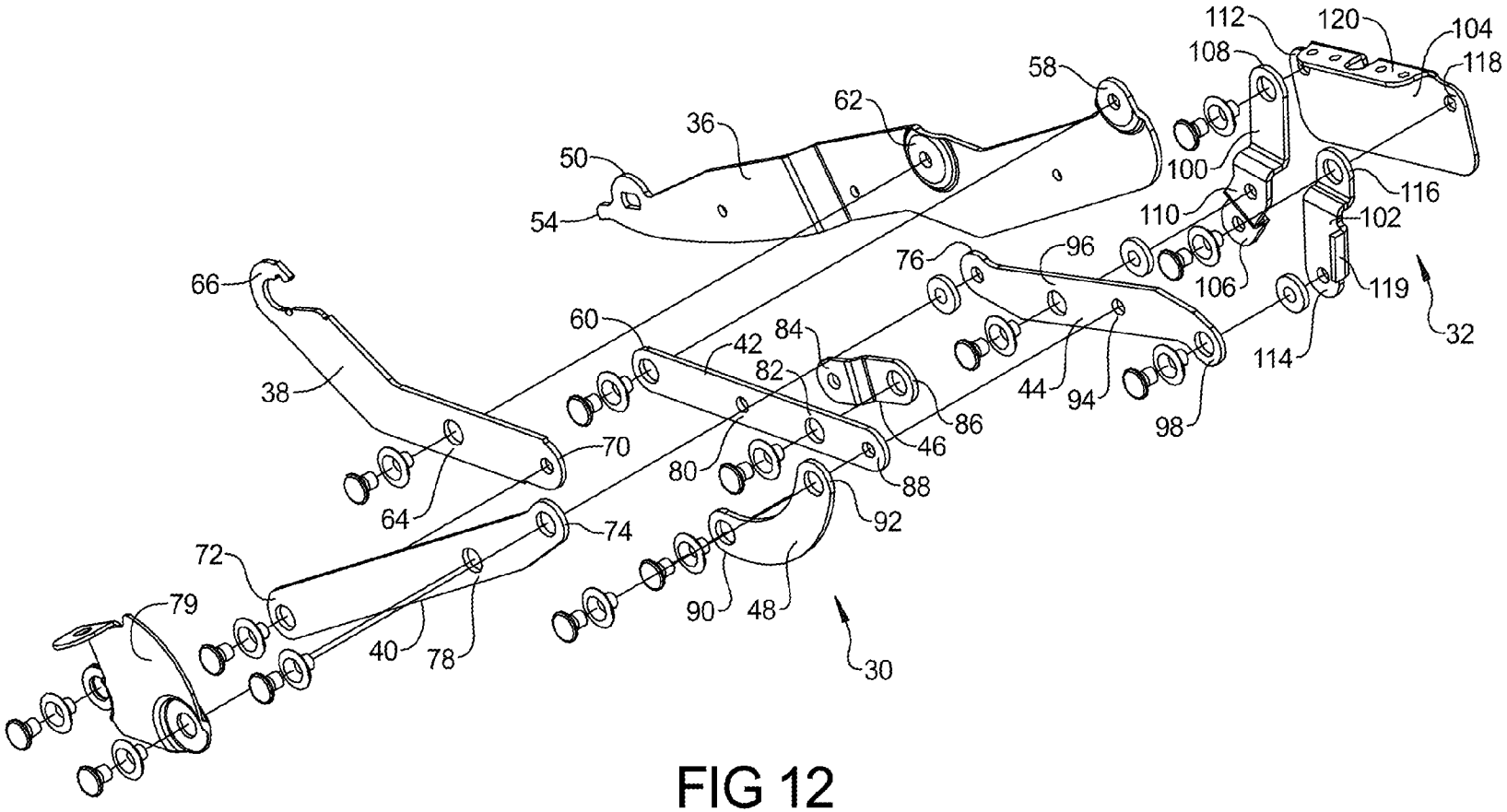
FIG. 12 is an exploded perspective view of the pantograph linkage and secondary linkage of FIG. 8.

As shown in FIGS. 10-12, for example, each of the pantograph linkages 30 may include a long support link 36, a swing link 38, an intermediate support link 40, a lower cross link 42, an upper cross link 44, a short support link 46, and a curved support link 48. As shown in FIGS. 10 and 11, a first end 50 of the long support link 36 may be rotatably coupled to an end 52 of the drive link 28. The first end 50 of the long support link 36 may include a first stop member 54 that interferes with a second stop member 56 disposed on the drive link 28 when the legrest mechanism 20 is in the fully extended position (FIG. 5). A second end 58 of the long support link 36 is rotatably coupled to a first end 60 of the lower cross link 42. An intermediate portion 62 of the long support link 36 (disposed between the first and second ends 50, 58) is rotatably coupled to an intermediate portion 64 of the swing link 38.

A first end 66 of the swing link 38 may be rotatably coupled to a support rod 68 (FIGS. 6 and 7) that is mounted to the chair body 12. As shown in FIG. 11, a second end 70 of the swing link 38 may be rotatably coupled to a first end 72 of the intermediate support link 40. The intermediate portion 64 of the swing link 38 is disposed between the first and second ends 66, 70.

As shown in FIGS. 5 and 11, a second end 74 of the intermediate support link 40 is rotatably coupled to a first end 76 of the upper cross link 44. An intermediate portion 78 of the intermediate support link 40 (disposed between the first and second ends 72, 74) is rotatably coupled to a first intermediate portion 80 of the lower cross link 42. In some configurations, an ottoman link 79 may be rotatably coupled to the intermediate portion 78 of the intermediate support link 40 and rotatably coupled to the second end 58 of the long support link 36. An ottoman platform 81 (FIG. 7) may be mounted to the ottoman links 79 of both pantograph linkages 30. As shown in FIGS. 10 and 11, a second intermediate portion 82 of the lower cross link 42 is rotatably coupled to a first end 84 of the short support link 46. A second end 86 (FIGS. 4 and 10) of the short support link 46 is rotatably coupled to the secondary linkage 32.

Figure 4:
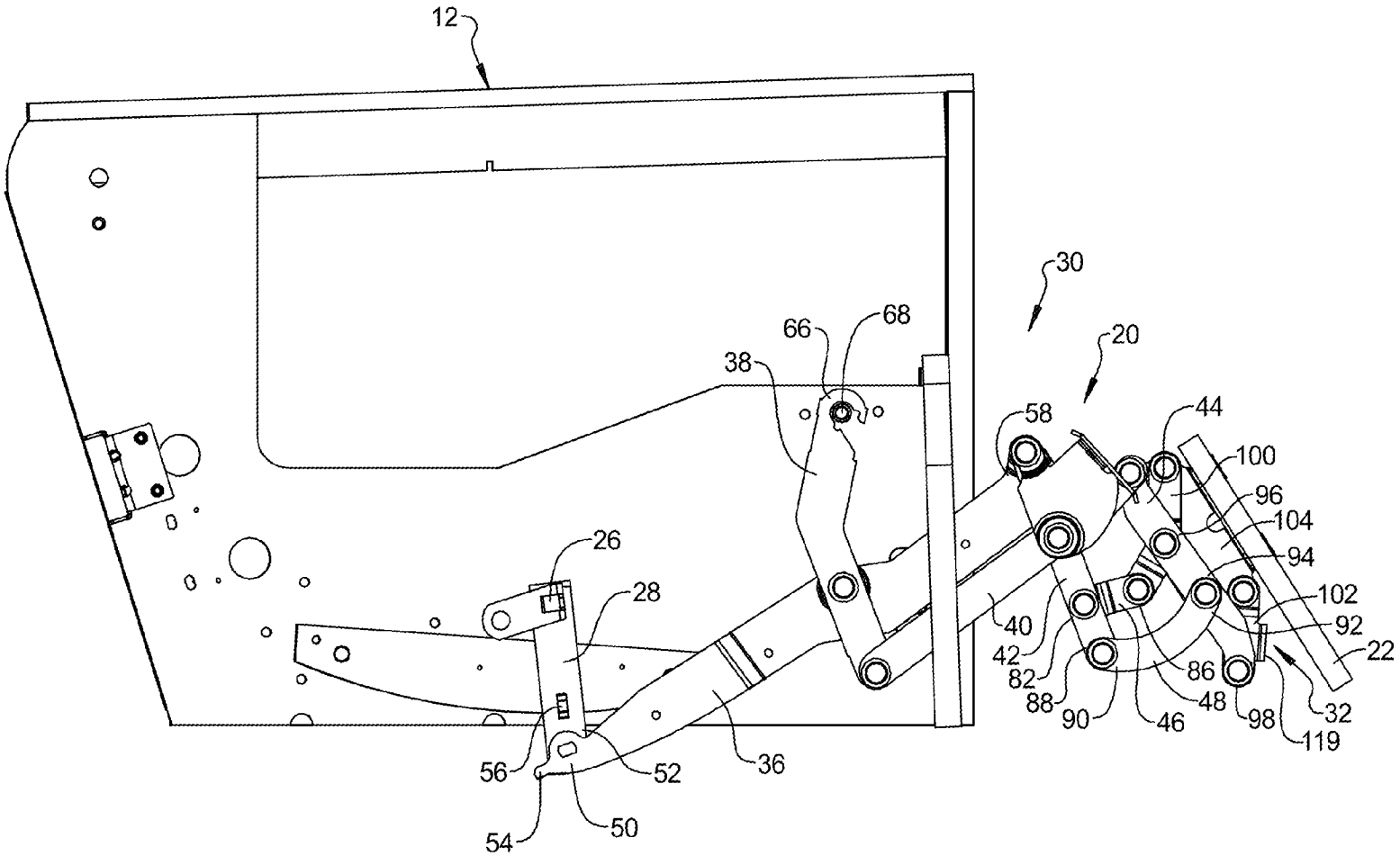
FIG. 4 is a side view of the portion of the chair body and the legrest mechanism of FIG. 3 in a partially extended position.

As shown in FIGS. 4 and 11, a second end 88 of the lower cross link 42 is rotatably coupled to a first end 90 of the curved support link 48. A second end 92 of the curved support link 48 is rotatably coupled to a first intermediate portion 94 of the upper cross link 44. A second intermediate portion 96 of the upper cross link 44 and the second end 98 of the upper cross link 44 are rotatably coupled to the secondary linkage 32.

Figure 9:
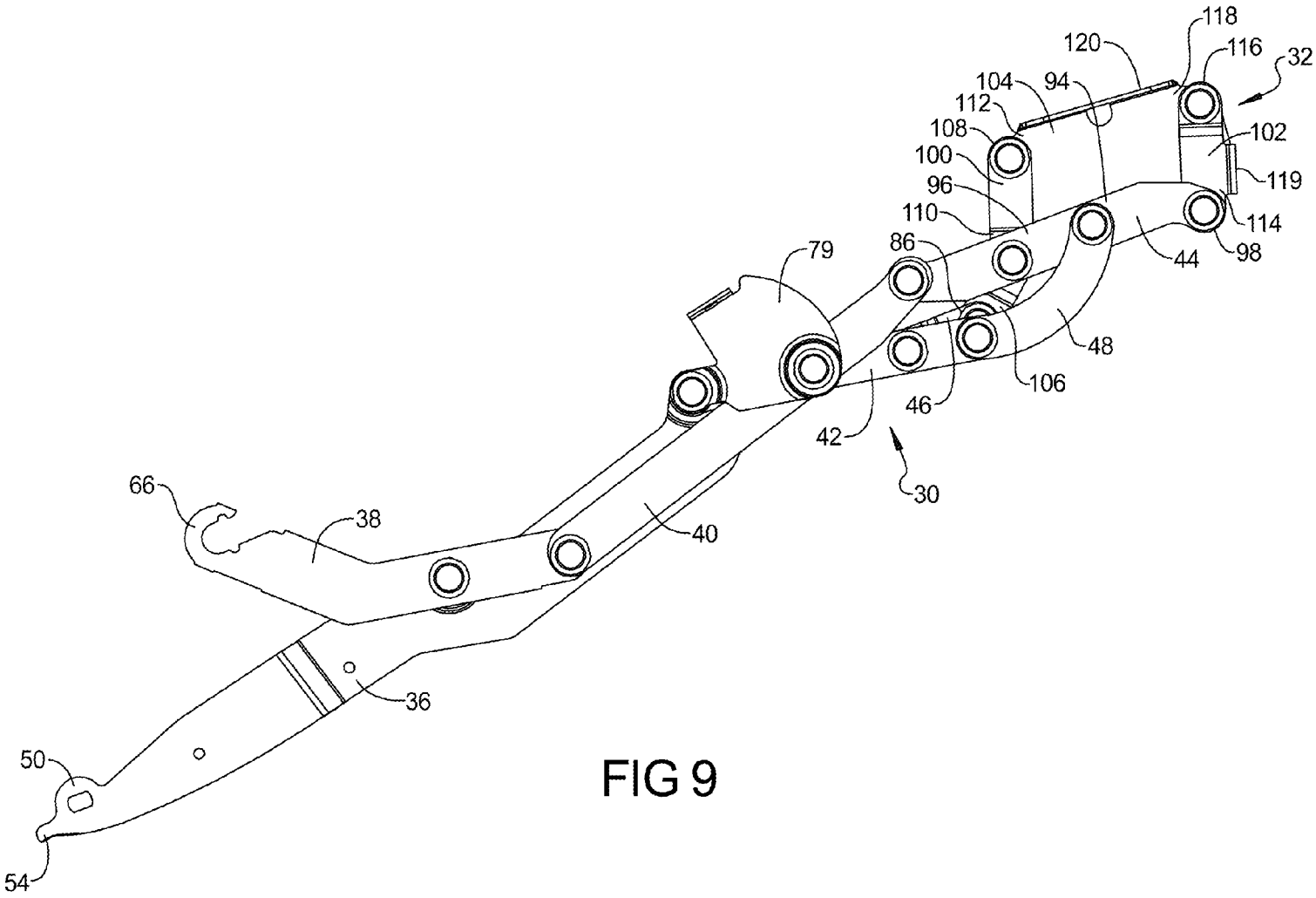
FIG. 9 is a side view of the pantograph linkage and secondary linkage of FIG. 8 in the fully extended position.

As shown in FIGS. 9, 10 and 12, each of the secondary linkages 32 may be a four-bar linkage and may include a rear board link 100, a front board link 102 and an angle bracket link 104. The rear board link 100 includes a first end portion 106, a second end portion 108 and an intermediate portion 110 disposed between the first and second end portions 106, 108. The first end portion 106 may be angled relative to the second end portion 108 and the intermediate portion 110. The first end portion 106 may be rotatably coupled to the second end 86 of the short support link 46. The second end portion 108 of the rear board link 100 may be rotatably coupled to a first end 112 of the angle bracket link 104. The intermediate portion 110 of the rear board link 100 may be rotatably coupled to the second intermediate portion 96 of the upper cross link 44.

Figure 3:
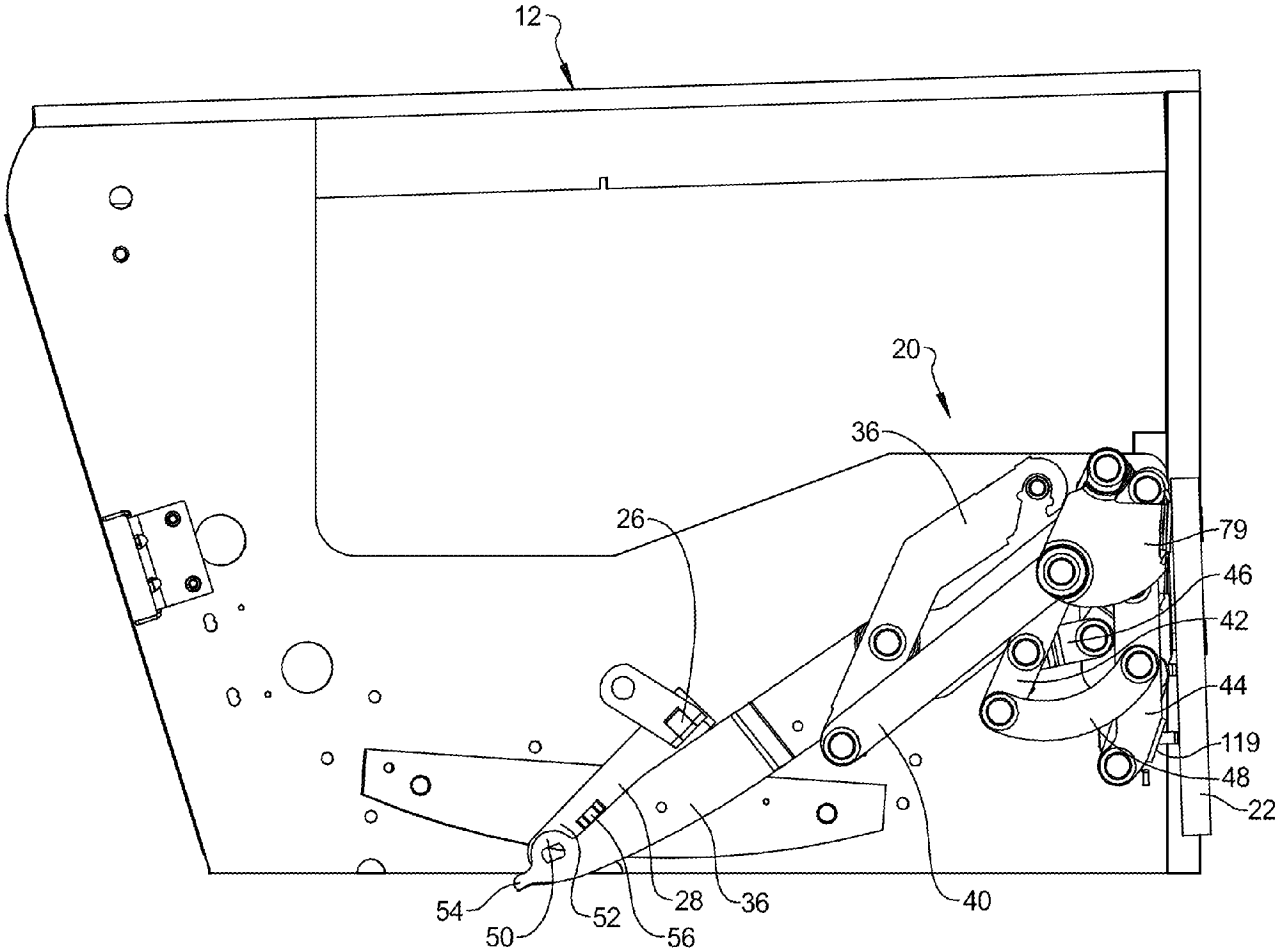
FIG. 3 is a side view of a portion of a chair body of the furniture member and a legrest mechanism in a retracted position.
Figure 8:
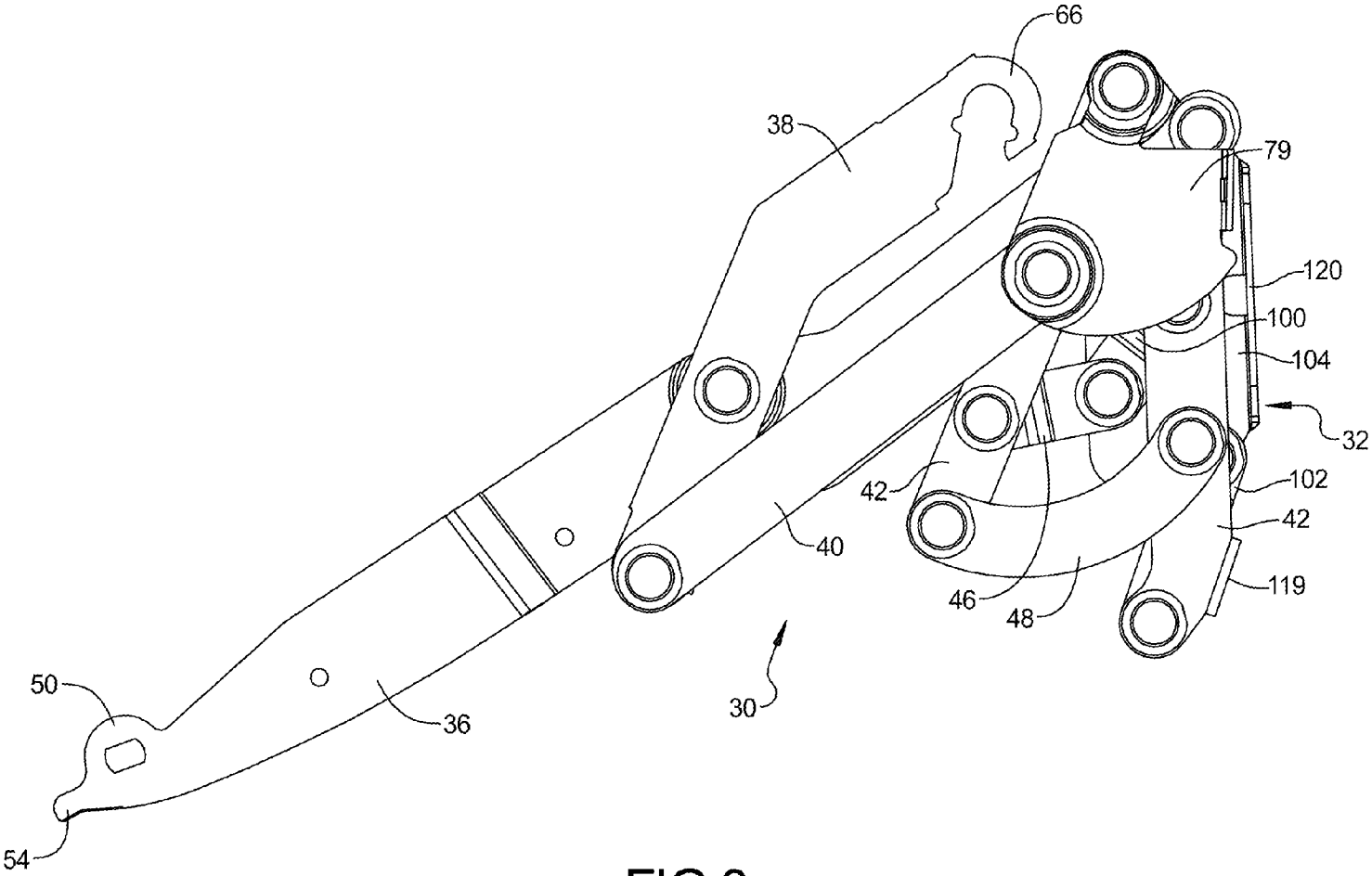
FIG. 8 is a side view of one of the pantograph linkages and one of the secondary linkages of FIG. 6 in the retracted position.

As shown in FIGS. 9, 11 and 12, the front board link 102 may include a first end 114 rotatably coupled to the second end 98 of the upper cross link 44. A second end 116 of the front board link 102 may be rotatably coupled to a second end 118 of the angle bracket link 104. The front board link 102 may include a stop member 119 that may contact the upper cross link 44 in the retracted position (as shown in FIGS. 3 and 8) and act as a stop to limit movement of the legrest mechanism 20. The angle bracket link 104 may have a flange portion 120 (FIG. 11). As shown in FIG. 5, the legrest platform 22 is mounted to the flange portions 120 of the angle bracket links 104 of both of the secondary linkages 32.

As shown in FIGS. 3-5, the secondary linkages 32 are movable from a folded position (FIG. 3) to a deployed position (FIG. 5) in response to movement of the pantograph linkages 30 between the retracted and extended positions. The secondary linkages 32 may be continuously movable between the folded and deployed positions over the entire range of motion of the pantograph linkages 30. That is, movement of the secondary linkages 32 from the folded position to deployed position may begin and end concurrently with the beginning and ending of the movement of pantograph linkages 30 from the retracted position to the fully extended position.

Figure 13:
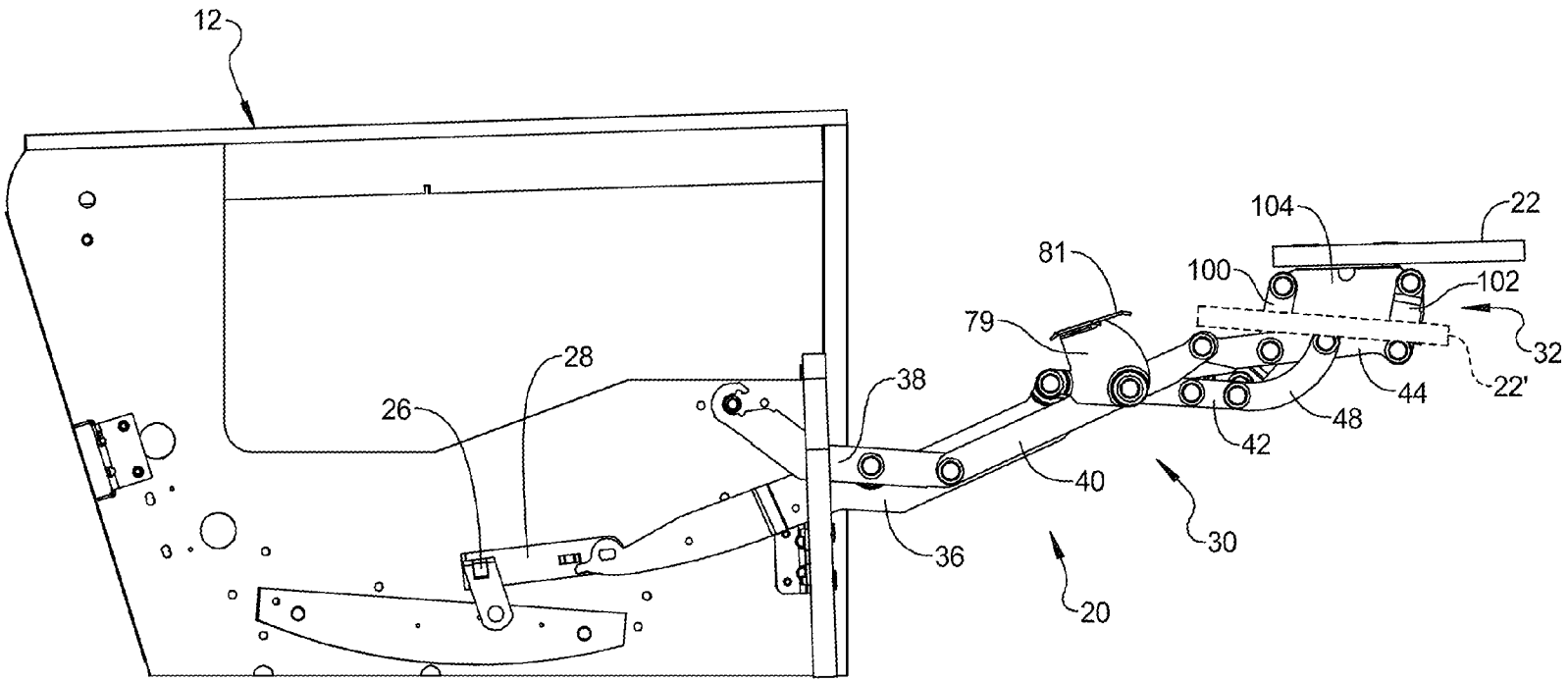
FIG. 13 is a side view of the portion of the chair body and legrest mechanism of FIG. 3 in which a position of a legrest platform (solid lines) supported by the legrest mechanism having secondary linkages is illustrated in comparison to a relative position a legrest platform (phantom lines) supported by the same legrest mechanism that does not include the secondary linkages.

FIG. 13 depicts the legrest mechanism 20 and legrest platform 22 of the present disclosure in the fully extended position. FIG. 13 also depicts the position of a legrest platform 22' if the legrest platform 22' were mounted to the same legrest mechanism in a fully extended position without the secondary linkages 32. As shown in FIG. 13, the secondary linkages 32 are able to extend the legrest platform 22 to a position that is vertically higher than the fully extended position of the legrest platform 22' and extended farther away from the chair body 12 (in a horizontal direction) than the fully extended position of the legrest platform 22'. In some embodiments, the additional vertical extension may be about two inches, and the additional horizontal extension may be about two inches. In other embodiments, the additional vertical and/or horizontal extension may be more or less than two inches. The additional vertical and horizontal extension of the legrest platform 22 locates the legrest platform 22 in a position that is more comfortable for some users. For example, taller users and/or users with longer legs may find that the additional extension provided by the secondary linkages 32 provides more comfortable support for their legs and/or feet.

Because all of or much of the rear and front board links 100, 102 and the angle bracket links 104 are folded behind or aligned with the upper cross link 44 when the legrest mechanism 20 is in the retracted position (as shown in FIG. 3), the legrest mechanism 20 with the secondary linkages 32 does not require any significant amount of additional space in the chair body 12 within which to retract (when compared to the amount of space in the chair body 12 that would be required to stow the same legrest mechanism without the secondary linkages 32). Therefore, the secondary linkages 32 increase the vertical and horizontal extension of the legrest platform 22 without needing any additional space within the chair body 12 when the legrest mechanism 20 is in the retracted position.

Figure 15:
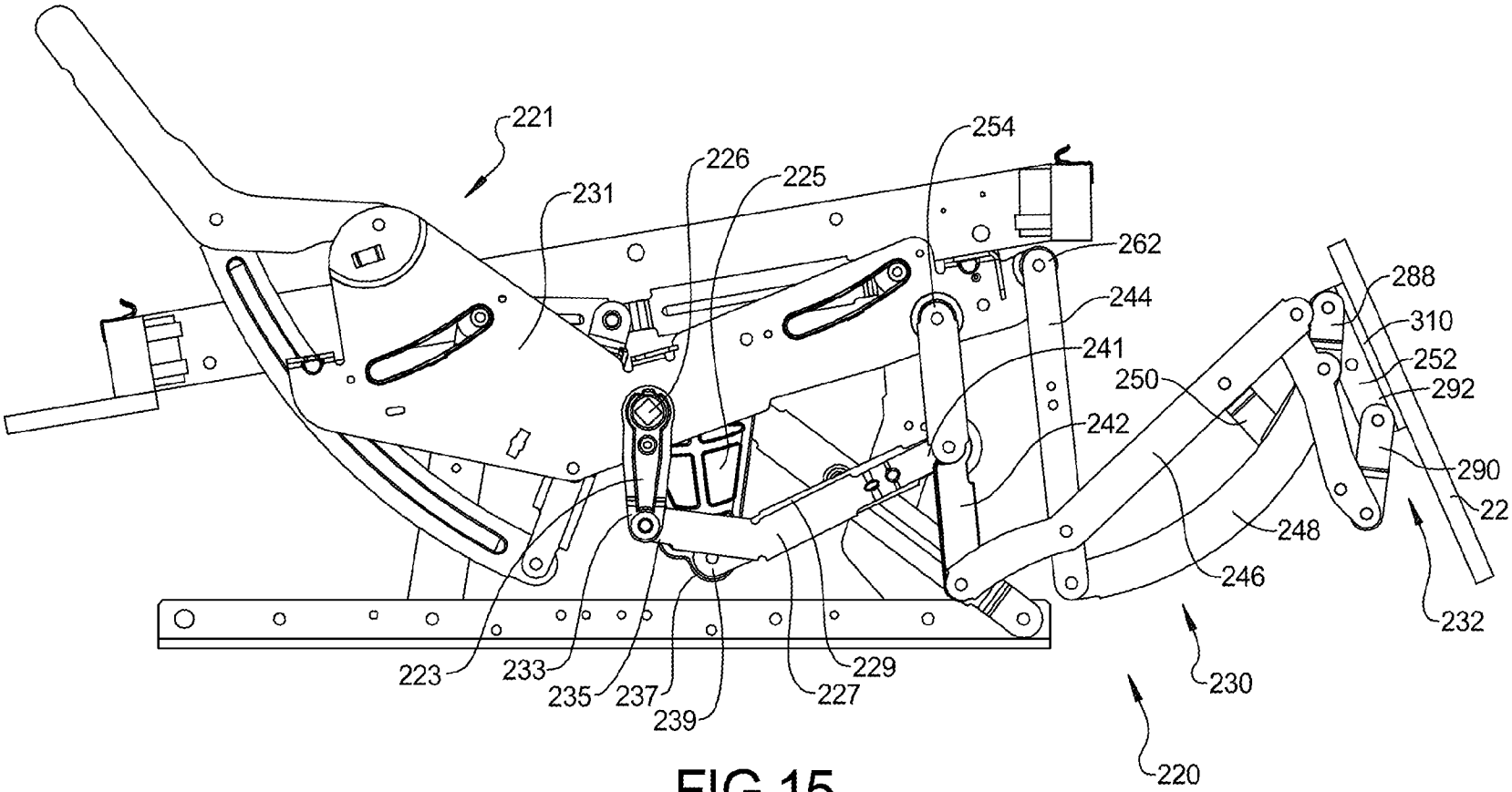
FIG. 15 is a side view of the seatback recliner mechanism in the upright position and the legrest mechanism of FIG. 14 in a partially extended position.
Figure 16:
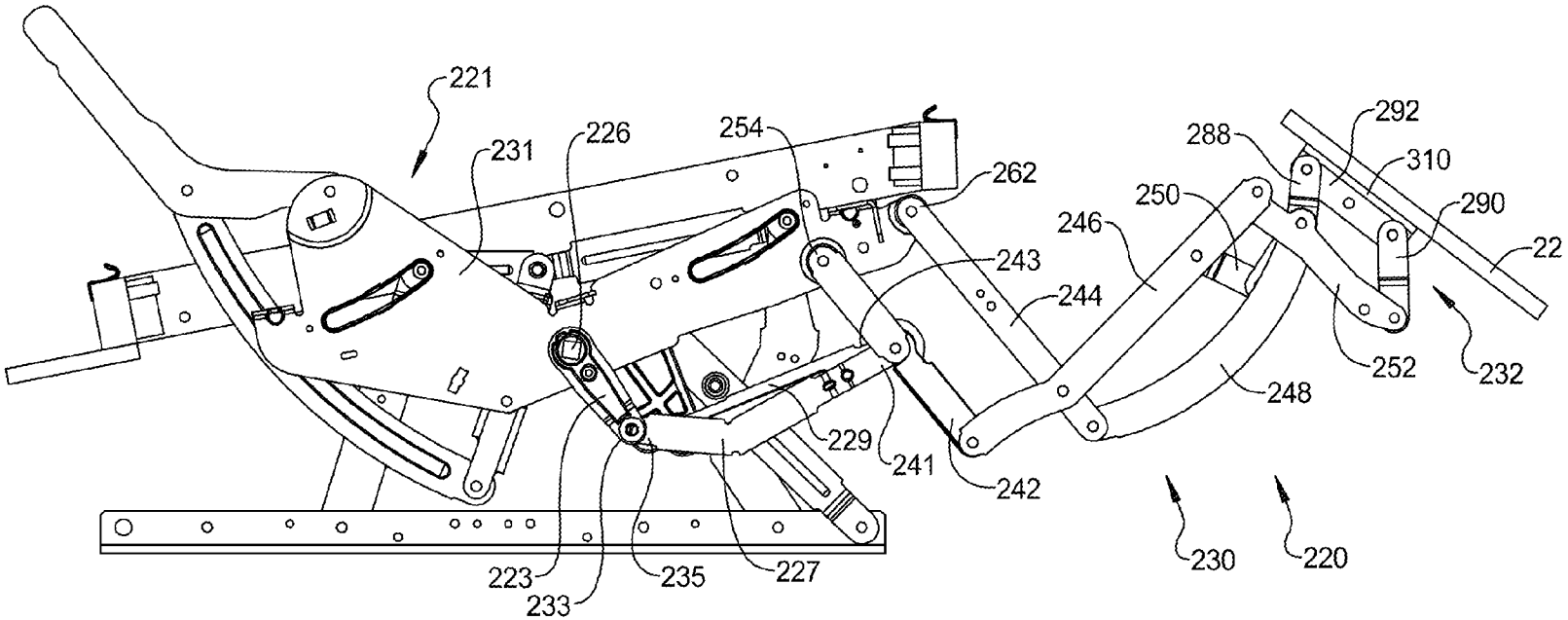
FIG. 16 is a side view of the seatback recliner mechanism in the upright position and the legrest mechanism of FIG. 14 in a further extended position.
Figure 17:
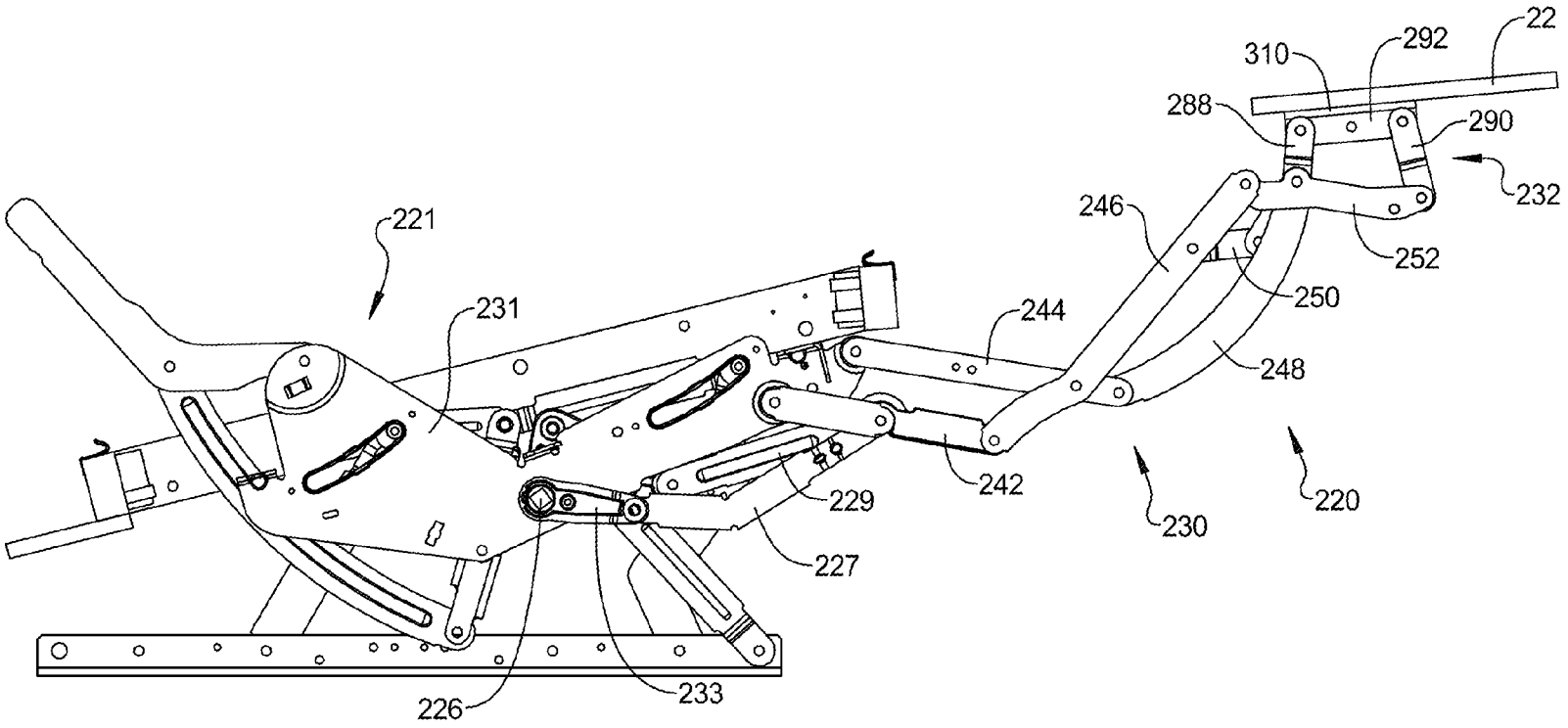
FIG. 17 is a side view of the seatback recliner mechanism in the upright position and the legrest mechanism of FIG. 14 in a fully extended position.
Figure 18:
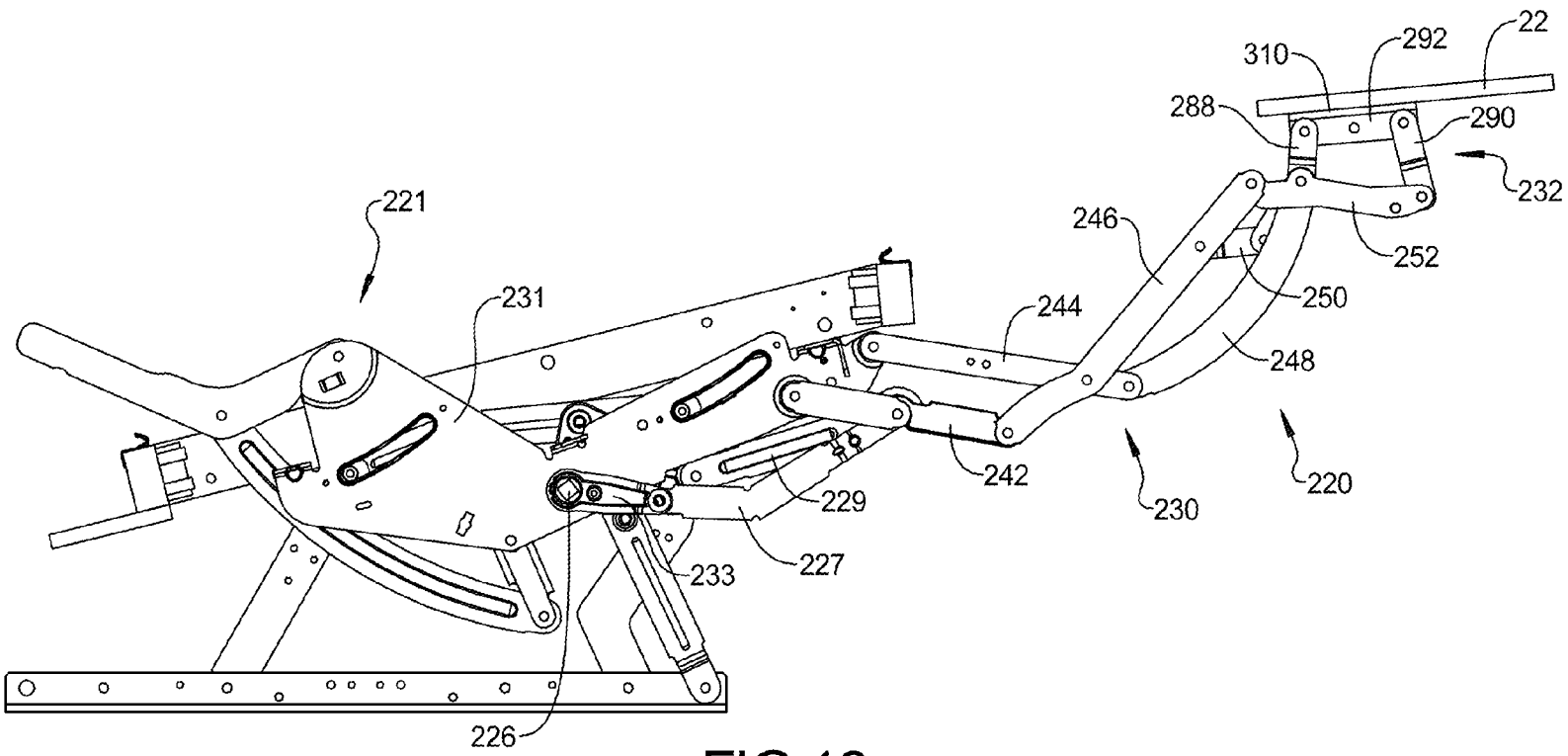
FIG. 18 is a side view of the seatback recliner mechanism in a reclined position and the legrest mechanism of FIG. 14 in a fully extended position.

With reference to FIGS. 14-20, another legrest mechanism 220 is provided that may be incorporated into the furniture member 10 (FIGS. 1 and 2) instead of the legrest mechanism 20 described above. The legrest mechanism 220 may be movable relative to the chair body 12 (FIGS. 1 and 2) between a retracted position (FIG. 14) and an extended position (FIGS. 17 and 18). The legrest mechanism 220 may be mounted to a seatback recliner mechanism 221 that is operable to move the seatback 14 (FIGS. 1 and 2) of the furniture member 10 between an upright position and a reclined position. The recliner mechanism 221 may have similar or identical structure and function as that of the recliner mechanism disclosed in assignee's commonly owned U.S. Pat. No. 7,585,018, the disclosure of which is hereby incorporated by reference.

As shown in FIGS. 15 and 16, the legrest mechanism 220 may include a pair of first crank links 223 (only one shown), a pair of second crank links 225 (only one shown), a pair of first drive links 227 (only one shown), a pair of second drive links 229 (only one shown), a pair of pantograph linkages 230 (only one shown), and a pair of secondary linkages 232 (only one shown). The first and second crank links 223, 225 may be rotatably mounted to a side plate 231 of the recliner mechanism 221. Each of the first crank links 223 may be rotatably coupled to a drive rod 226 which may be connected to and driven by the handle 18 (FIGS. 1 and 2). An end 233 of each first crank link 223 may be rotatably coupled to a first end 235 of the corresponding first drive link 227. An end 237 of each second crank link 225 may be rotatably coupled to a first end 239 of the corresponding second drive link 229. Second ends 241, 243 (FIG. 20) of the first and second drive links 227, 229, respectively, may be rotatably coupled to the pantograph linkages 230.

Figure 19:
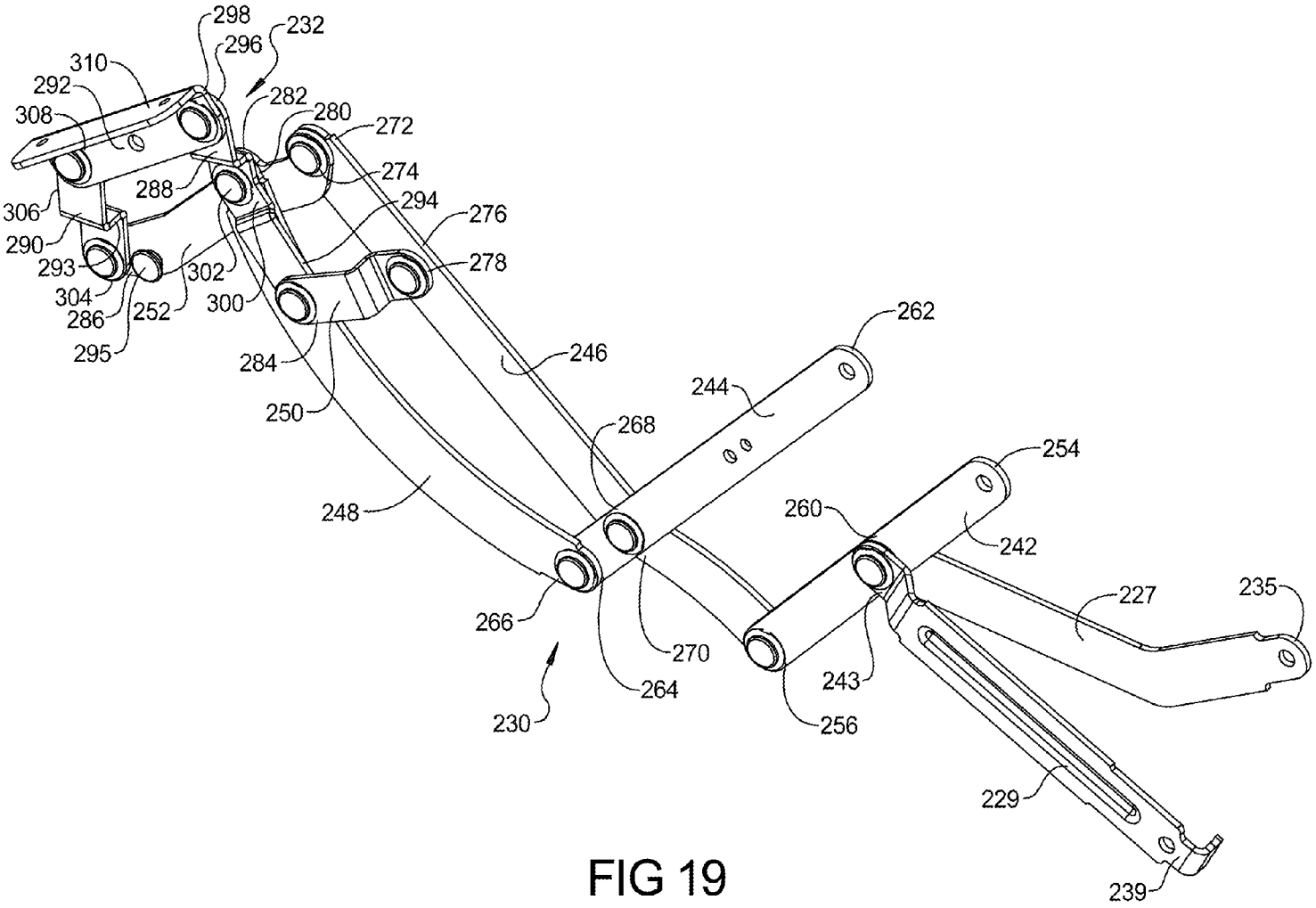
FIG. 19 is a perspective view of a pantograph linkage and secondary linkage of the legrest mechanism of FIG. 14 in a partially extended position.
Figure 20:
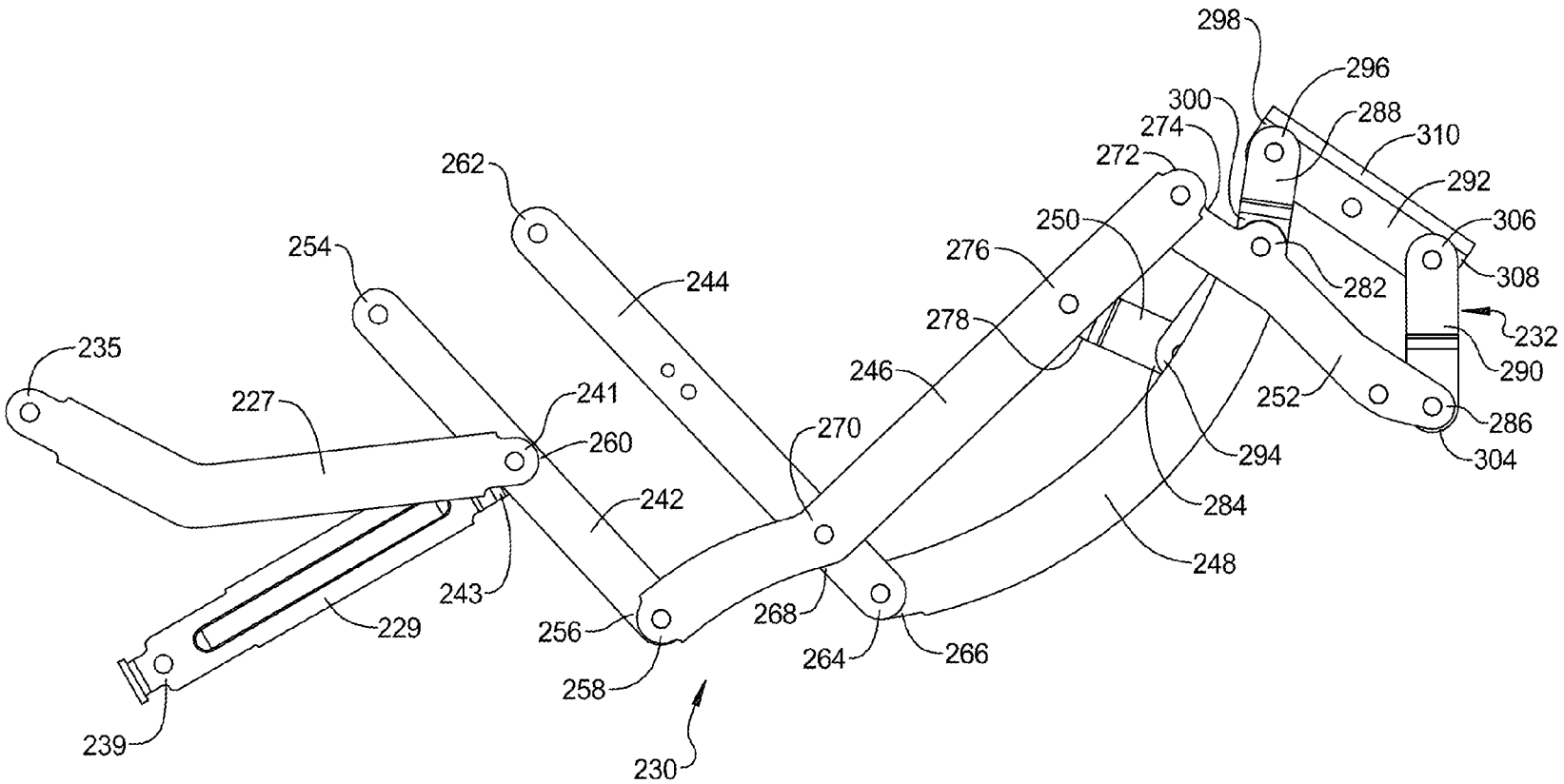
FIG. 20 is a side view of the pantograph linkage and secondary linkage of the legrest mechanism of FIG. 14 in a partially extended position.

As shown in FIGS. 19 and 20, each of the pantograph linkages 230 may include a rear swing link 242, a front swing link 244, a first support link 246, a second support link 248, a lower cross link 250, and an upper cross link 252. A first end 254 of the rear swing link 242 may be rotatably coupled to the side plate 231 (as shown in FIG. 15). A second end 256 of the rear swing link 242 may be rotatably coupled to a first end 258 of the first support link 246. An intermediate portion 260 of the rear swing link 242 may be rotatably coupled to the second ends 241, 243 of the first and second drive links 227, 229.

A first end 262 of the front swing link 244 may be rotatably coupled to the side plate 231 (as shown in FIG. 15). A second end 264 of the front swing link 244 may be rotatably coupled to a first end 266 of the second support link 248. An intermediate portion 268 of the front swing link 244 may be rotatably coupled to a first intermediate portion 270 of the first support link 246.

A second end 272 of the first support link 246 may be rotatably coupled to a first end 274 of the upper cross link 252. A second intermediate portion 276 of the first support link 246 may be rotatably coupled to a first end 278 of the lower cross link 250. The second intermediate portion 276 of the first support link 246 is disposed between the second end 272 and the first intermediate portion 270. A second end 280 (FIG. 19) of the second support link 248 may be rotatably coupled to an intermediate portion 282 of the upper cross link 252. A second end 284 of the lower cross link 250 is rotatably coupled to the secondary linkage 232. A second end 286 of the upper cross link 252 is also rotatably coupled to the secondary linkage 232.

As shown in FIGS. 19 and 20, each of the secondary linkages 232 may be a four-bar linkage and may include a rear board link 288, a front board link 290 and an angle bracket link 292. As shown in FIGS. 14-18, the secondary linkages 232 are movable from a folded position (FIG. 14) to a fully deployed position (FIGS. 17 and 18) in response to movement of the pantograph linkages 230 between the retracted and extended positions. The secondary linkages 232 may be continuously movable between the folded and deployed positions over the entire range of motion of the pantograph linkages 230. That is, movement of the secondary linkages 232 from the folded position to deployed position may begin and end concurrently with the beginning and ending of the movement of pantograph linkages 230 from the retracted position to the fully extended position.

The rear board link 288 includes a first end 294 rotatably coupled to the second end 284 of the lower cross link 250. A second end 296 of the rear board link 288 is rotatably coupled to a first end 298 of the angle bracket link 104. An intermediate portion 300 of the rear board link 288 (disposed between the first and second ends 294, 296) may be rotatably coupled to the intermediate portion 282 of the upper cross link 252. As shown in FIG. 19, the second end 280 of the second support link 248, the intermediate portion 282 of the upper cross link 252 and the intermediate portion 300 of the rear board link 288 are all rotatably coupled to each other about a common rotational axis defined by pin 302.

Figure 14:
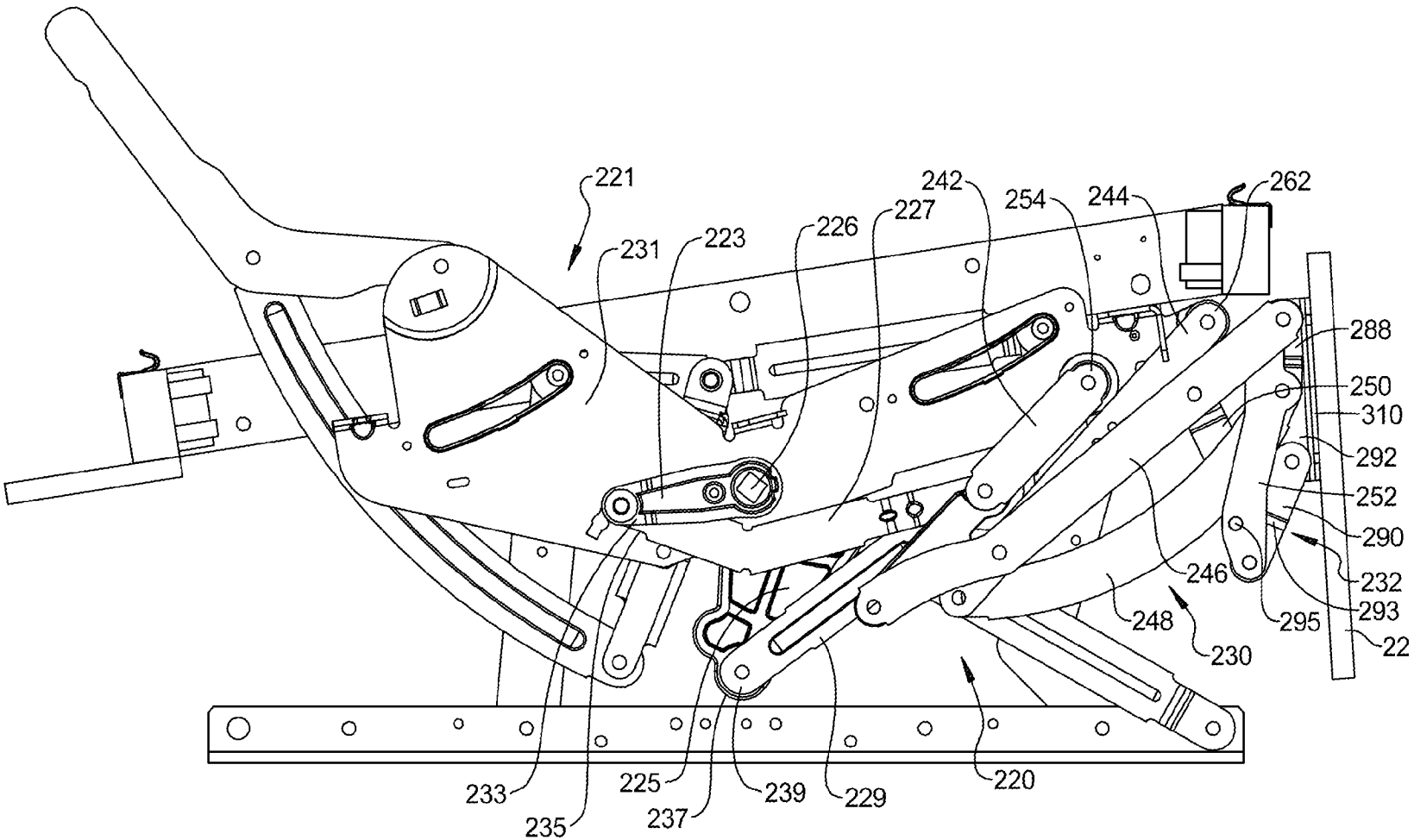
FIG. 14 is a side view of a seatback recliner mechanism in an upright position and another legrest mechanism in a retracted position.

As shown in FIGS. 19 and 20, the front board link 290 includes a first end 304 that is rotatably coupled to the second end 286 of the upper cross link 252. A second end 306 of the front board link 290 is rotatably coupled to a second end 308 of the angle bracket link 292. As shown in FIGS. 14 and 19, the front board link 290 may include a step 293 that interferes with a rivet 295 extending from the upper cross link 252 when the legrest mechanism 220 is in the fully retracted position. In this manner, the step 293 and rivet 295 act as stop members that limit a range of motion of the legrest mechanism 220. The angle bracket link 292 may have a flange portion 310. As shown in FIGS. 14-18, the legrest platform 22 is mounted to the flange portions 310 of the angle bracket links 292 of both of the secondary linkages 232.

As described above with respect to the legrest mechanism 20, the secondary linkages 232 of the legrest mechanism 220 are able to extend the legrest platform 22 to a position that is vertically higher and extended farther away from the chair body 12 (in a horizontal direction) than the fully extended position of the legrest 22' (FIG. 13). In some embodiments, the additional vertical extension may be about two inches, and the additional horizontal extension may be about two inches. In other embodiments, the additional vertical and/or horizontal extension may be more or less than two inches. As described above, the additional vertical and horizontal extension of the legrest platform 22 locates the legrest platform 22 in a position that is more comfortable for some users.

Because some or all of the rear and front board links 288, 290 and the angle bracket links 292 are folded behind or aligned with the upper cross link 252 when the legrest mechanism 220 is in the retracted position (as shown in FIG. 14), the legrest mechanism 220 with the secondary linkages 232 does not require any significant amount of additional space in the chair body 12 within which to retract (when compared to the amount of space in the chair body 12 that would be required to stow the same legrest mechanism without the secondary linkages 232). Therefore, the secondary linkages 232 increase the vertical and horizontal extension of the legrest platform 22 without needing any additional space within the chair body 12 when the legrest mechanism 220 is in the retracted position.

While the furniture member 10 is described above and shown in the figures as being a recliner chair, it will be appreciated that either of the legrest mechanisms 20, 220 could be incorporated into other types of furniture members such as sofas, loveseats, sectionals, or any other motion furniture products. Furthermore, while the drive rods 26, 226 are described above as being connected to and actuated by the handle 18, it will be appreciated that the drive rods 26, 226 could be driven by an electric motor.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A legrest mechanism comprising:

a pantograph linkage movable between a retracted position and an extended position and including:

a first support link rotatably coupled at a first end to a drive member;

a swing link including first and second ends and an intermediate portion disposed between the first and second ends, the first end of the swing link rotatably coupled relative to a frame of a furniture member, the intermediate portion rotatably coupled to the first support link;

a second support link rotatably coupled to the second end of the swing link and oriented relative to the first support link such that an angle between the first and second support links is constant in both of the retracted and extended positions;

a first cross link rotatably coupled to the first support link and rotatably coupled to the second support link; and a second cross link rotatably coupled to the second support link and connected to the first cross link by a support member; and a four-bar linkage connected to the second cross link and including front and rear board links and a bracket link rotatably coupled to the front and rear board links, the bracket link attached to and supporting a legrest platform, the four-bar linkage is rotatable relative to the second cross link in response to movement of the pantograph linkage between the extended and retracted positions.

2. The legrest mechanism of claim 1, wherein the four-bar linkage rotates relative to the second cross link continuously as the pantograph linkage moves between the extended and retracted positions, wherein such continuous rotation of the four-bar linkage occurs over the entire range of motion of the pantograph linkage.

3. The legrest mechanism of claim 2, wherein the first cross link is rotatably coupled to a second end of the first support link and rotatably coupled to an intermediate portion of the second support link.

4. The legrest mechanism of claim 1, wherein the front and rear board links are rotatably coupled to the second cross link.

5. The legrest mechanism of claim 4, wherein the support member is a portion of the rear board link.

6. The legrest mechanism of claim 4, wherein the legrest platform is fixedly mounted to the bracket link.

7. The legrest mechanism of claim 1, wherein the front and rear board links are rotatably coupled to the first cross link.

8. The legrest mechanism of claim 7, wherein the support member is a third support link that is rotatable relative to the rear board link.

9. The legrest mechanism of claim 7, wherein the legrest platform is fixedly mounted to the bracket link.

10. The legrest mechanism of claim 1, wherein the pantograph linkage includes a third support link that extends between and is rotatably coupled to the first and second cross links.

11. The legrest mechanism of claim 1, wherein the first support link includes a first stop member and the drive link includes a second stop member that interferes with the first stop member when the pantograph linkage is in the extended position.

12. The legrest mechanism of claim 1, further comprising an ottoman link rotatably coupled to the second support link and the first cross link, the ottoman link fixedly supporting an ottoman platform.

13. The legrest mechanism of claim 1, wherein the four-bar linkage includes a stop member that interferes with the pantograph linkage in the retracted position to limit a range of motion of the legrest mechanism.

14. A legrest mechanism comprising;

a pantograph linkage movable between a retracted position and an extended position and including:

a first support link rotatably coupled at a first end to a drive member;

a swing link including an intermediate portion rotatably coupled to the first support link;

a second support link rotatably coupled to the swing link and oriented relative to the first support link such that an angle between the first and second support links is constant in both of the retracted and extended positions; and a cross link rotatably coupled to the second support link; and a secondary linkage connected to the cross link and including front and rear board links and a bracket link, the bracket link fixedly supporting a legrest platform, the secondary linkage is rotatable relative to the cross link in response to movement of the pantograph linkage between the extended and retracted positions.

15. The legrest mechanism of claim 14, wherein the secondary linkage rotates relative to the cross link continuously as the pantograph linkage moves between the extended and retracted positions, wherein such continuous rotation of the secondary linkage occurs over the entire range of motion of the pantograph linkage.

16. The legrest mechanism of claim 14, wherein the cross link is connected to another cross link by a support member.

17. The legrest mechanism of claim 16, wherein the other cross link is rotatably coupled to the first support link and rotatably coupled to the second support link.

18. The legrest mechanism of claim 17, wherein the pantograph linkage includes a third support link that extends between and is rotatably coupled to both cross links.

19. The legrest mechanism of claim 14, wherein a first end of the swing link is rotatably coupled relative to a frame of a furniture member.

20. The legrest mechanism of claim 19, wherein a second end of the swing link is rotatably coupled to the second support link.

21. The legrest mechanism of claim 14, wherein the first support link includes a first stop member and the drive link includes a second stop member that interferes with the first stop member when the pantograph linkage is in the extended position.

22. The legrest mechanism of claim 21, wherein the secondary linkage includes a stop member that interferes with the pantograph linkage in the retracted position to limit a range of motion of the legrest mechanism.

* * * * *